US009353532B2

(12) United States Patent
Peterson et al.

(10) Patent No.: US 9,353,532 B2
(45) Date of Patent: May 31, 2016

(54) DECK DRAINAGE SYSTEMS

(71) Applicant: JPCM LLC, Littleton, CO (US)

(72) Inventors: Jim Peterson, Littleton, CO (US); Craig MacRae, Littleton, CO (US)

(73) Assignee: JPCM LLC, Littleton, CO (US)

( * ) Notice: Subject to any disclaimer, the term of this patent is extended or adjusted under 35 U.S.C. 154(b) by 0 days.

(21) Appl. No.: 14/064,889

(22) Filed: Oct. 28, 2013

(65) Prior Publication Data

US 2015/0033649 A1 Feb. 5, 2015

Related U.S. Application Data

(63) Continuation-in-part of application No. 13/958,319, filed on Aug. 2, 2013.

(51) Int. Cl.
*E04F 17/00* (2006.01)
*E04F 15/02* (2006.01)

(52) U.S. Cl.
CPC ..... *E04F 15/02183* (2013.01); *E04F 17/00* (2013.01)

(58) Field of Classification Search
CPC ... E04D 13/0477; E04D 13/1625; E04D 3/38; E04B 5/12; E04F 15/02183; E04F 17/00
USPC ..... 52/302.3, 302.1, 127.5, 464, 14, 15, 98, 52/100, 716.2, 846
See application file for complete search history.

(56) References Cited

U.S. PATENT DOCUMENTS

| | | | | |
|---|---|---|---|---|
| 3,319,384 | A * | 5/1967 | Berg | 52/100 |
| 3,667,174 | A * | 6/1972 | Arnett | 52/100 |
| 4,742,654 | A * | 5/1988 | Cole | 52/97 |
| 4,819,803 | A * | 4/1989 | Neiser | 206/423 |
| 4,860,502 | A | 8/1989 | Mickelsen | |
| 4,969,250 | A * | 11/1990 | Hickman et al. | 29/521 |
| 5,155,952 | A * | 10/1992 | Herwegh et al. | 52/100 |
| 5,358,757 | A * | 10/1994 | Robinette et al. | 428/43 |
| 5,765,328 | A | 6/1998 | Moore | |
| 5,918,427 | A * | 7/1999 | VanderWerf | 52/100 |
| 6,212,837 | B1 * | 4/2001 | Davis et al. | 52/302.1 |
| 6,226,941 | B1 | 5/2001 | Stevens | |
| 6,260,316 | B1 | 7/2001 | Davis et al. | |
| 6,343,450 | B1 | 2/2002 | Vance, Jr. | |
| 6,393,785 | B1 | 5/2002 | Burt | |
| 6,415,571 | B2 | 7/2002 | Risser | |
| 6,421,967 | B1 | 7/2002 | Wlaker | |
| 6,694,686 | B2 | 2/2004 | Ready | |
| 7,017,315 | B2 * | 3/2006 | Corwin | 52/407.3 |
| 8,146,315 | B2 * | 4/2012 | Ruhlmann et al. | 52/506.06 |
| 8,250,821 | B1 | 8/2012 | Gibson | |
| 2005/0035081 | A1 * | 2/2005 | Fitch | 215/246 |
| 2005/0217196 | A1 * | 10/2005 | Fogg | 52/698 |
| 2005/0252151 | A1 * | 11/2005 | Kindred | 52/650.3 |
| 2008/0250734 | A1 * | 10/2008 | Walker | 52/198 |
| 2009/0266018 | A1 | 10/2009 | Stockton | |

* cited by examiner

*Primary Examiner* — Robert Canfield
*Assistant Examiner* — Babajide Demuren

(57) ABSTRACT

A deck drainage system includes a bracket. The bracket has three parts selectively separable from each other. These parts include a first portion, a second portion, and a central portion joining the first and second portions. The first portion has a first leg and a first arm disposed at an angle to the first leg. The second portion has a second leg and a second arm disposed at an angle to the second leg. The central portion is generally flat.

11 Claims, 12 Drawing Sheets

DECK DRAINAGE SYSTEMS

CROSS-REFERENCE TO RELATED APPLICATIONS

This application is a continuation-in-part of U.S. patent application Ser. No. 13/958,319, filed Aug. 2, 2013, entitled "Deck Drainage Systems," the disclosure of which is hereby incorporated by reference herein in its entirety.

BACKGROUND

Outdoor decks or patios are often aligned vertically on the exterior of buildings (for example, apartment buildings) such that the deck of a lower unit is disposed below that of an upper unit. These outdoor decks are typically made of planks that span a number of joist members. When it rains, water falls through the planks of the deck and onto any decks located below. Thus, stacked exterior decks may not be desirable or useful during rainy conditions. Additionally, debris such as dirt, spilled food or beverages, or other items can fall through the planks from an upper deck to a lower deck and onto the occupants thereof. One solution is to attach waterproof sheathing material on the undersides of the joists to collect and redirect water and debris. This sheathing, however, is unsightly and can lower the perceived or actual clearance between the lower decks. Additionally, if the sheathing is not pitched properly, water may pool thereon. This pooling may lead to sheathing or joist degradation and rotting.

SUMMARY

In one aspect, the technology relates to a deck drainage system including: a bracket having: a first portion having a first leg and a first arm disposed at an angle to the first leg; a second portion having a second leg and a second arm disposed at an angle to the second leg; and a central portion connecting the first portion and the second portion, wherein the central portion is selectively separable from both the first portion and the second portion. In an embodiment, the central portion is connected to each of the first portion and the second portion at a seam. In embodiments, the seam is a perforation a thickness less than a thickness of the central portion, and/or a mark. In another embodiment, the central portion defines at least one separation element disposed substantially orthogonal to the seam.

In another aspect, the technology relates to a method of installing a deck drainage system, the method including: separating a top portion of a bracket from both of a first holding portion of the bracket and a second holding portion of the bracket; inserting a first edge of a sheet element into a first slot of the first holding bracket; inserting a second edge of the sheet element into a second slot of the second holding bracket; abutting a rear surface of the first holding bracket against a first joist; and abutting a rear surface of the second holding bracket against a second joist disposed facing the first joist. In an embodiment, the method includes: securing a first end of the top portion to the first joist; and securing a second end of the top portion to the second joist, such that the top portion spans the first joist and the second joist. In another embodiment, the top portion is disposed so as to support the sheet element once the sheet element is disposed between the first joist and the second joist. In yet another embodiment, the method includes dividing the top portion into a first top portion and a second top portion. In still another embodiment, the method includes: securing each of the first top portion and the second top portion to each of the first joist and the second joist, such that each of the first top portion and the second top portion span the first joist and the second joist. In another embodiment, each of the first top portion and the second top portion are disposed so as to support the sheet element once the sheet element is disposed between the first joist and the second joist.

In another aspect, the technology relates to a kit for useful in forming a deck drain, the kit including: a sheet element having a first edge and a second edge; a bracket, wherein the bracket is selectively separable into: a first bracket portion having a first slot adapted to receive the first edge; a second bracket portion including a second slot adapted to receive the second edge; and a top portion. In an embodiment, the first edge and the second edge define a taper. In another embodiment, the top portion of the bracket is adapted to support a portion of the sheet element once installed between a first joist and a second joist. In another embodiment, the first bracket portion has a flat rear surface adapted to abut a side surface of the first joist. In yet another embodiment, the first bracket portion has a tab adapted to conform to an upper structure disposed on an upper surface of the joist when the rear surface is abutting the side surface of the joist, wherein the tab is formed once the first bracket portion is separated from the top portion. In still another embodiment, the kit includes a screen adapted to be secured to a bottom surface of the first joist.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

Figure 1:
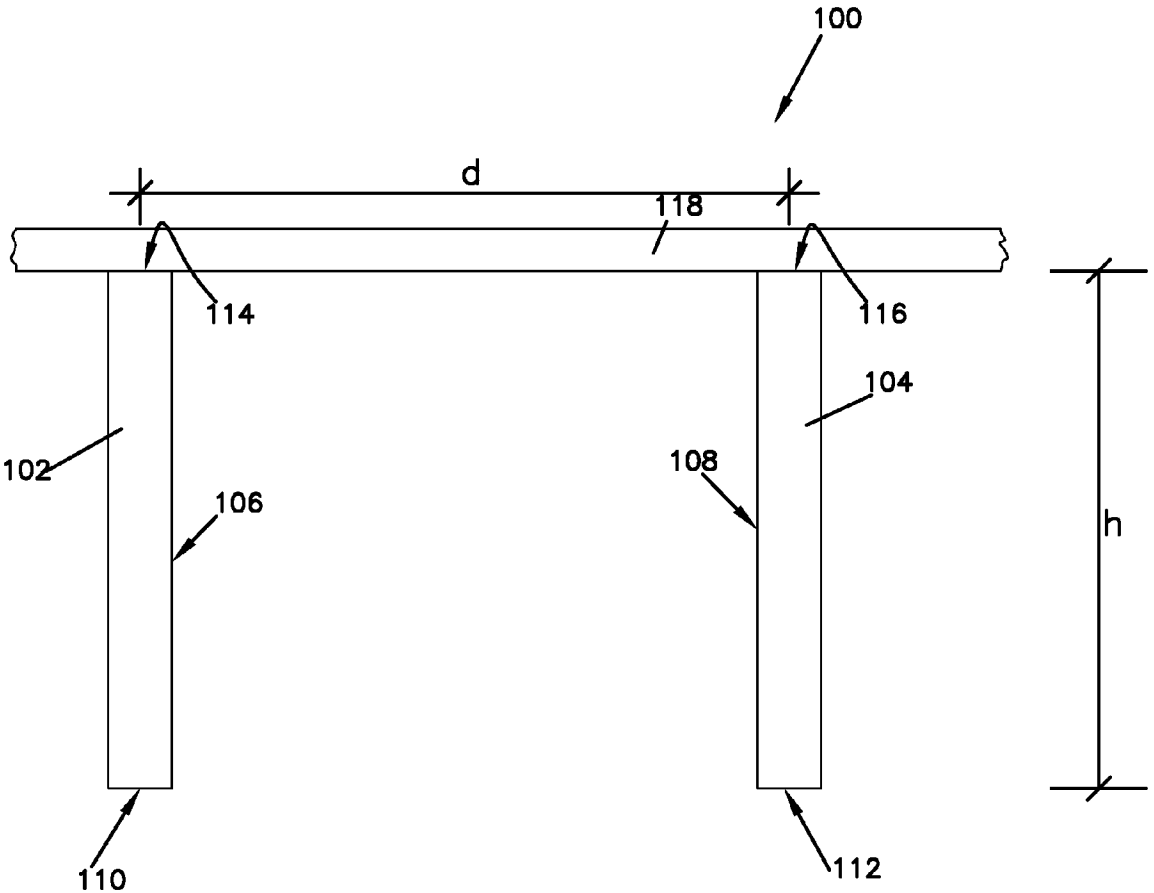
FIG. 1 is a partial end view of a deck.

The technologies described herein may be utilized in retrofit applications on existing decks, as well as on newly-constructed decks. Additionally, while the most common types of decks in residential construction are those utilizing wood joists and wood or wood-plastic composite decking, the systems and methods described herein may be utilized on decks manufactured of metal with few, if any, required modifications. An example of a deck 100 is depicted in FIG. 1. The support structure of the deck 100 includes joists 102, 104, typically installed with a center-to-center distance d of about 16 inches or about 12 inches. Of course, other distances may be utilized. The height h of each joist may be as required or desired for a particular application based on the materials selected. The joists 102, 104 have opposing side surfaces 106, 108, bottom surfaces 110, 112, and upper surfaces 114, 116. A plank structure 118 spans the plurality of joists 102, 104.

Figure 2:
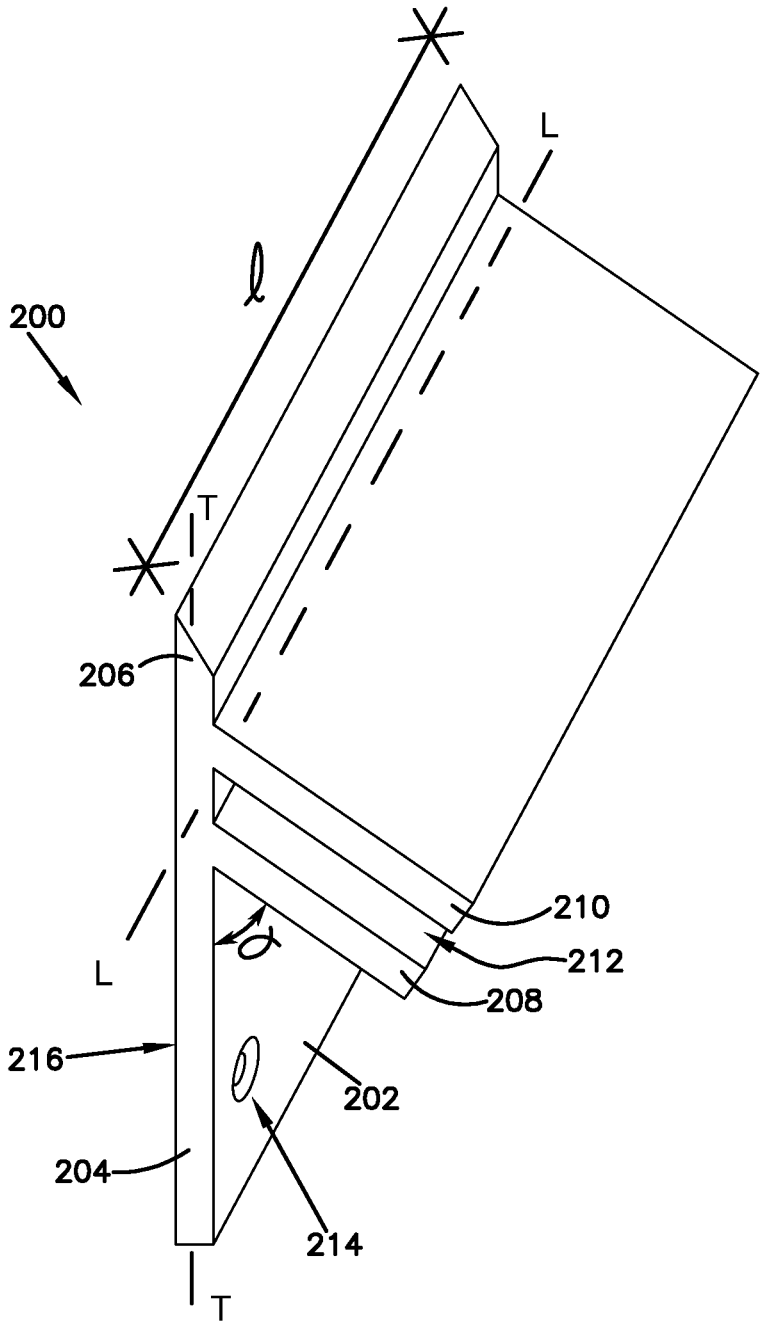
FIG. 2 is a perspective view of a deck drainage bracket.

FIG. 2 depicts a bracket 200 for a deck drainage system. The bracket 200 includes a body 202. The body 202 has a length l that defines an elongate axis L. The length l of the body 202 may be as required or desired for a particular application. In certain embodiments, the bracket 200 length l may be short, about 1 inch or so. As described below, however, in certain embodiments, it may be desirable that only one bracket 200 be used on either side of the deck drainage system. Thus, the length l of the bracket 200 may be substantially equal to the entire length of a joist upon which is it installed. A transverse axis T is substantially transverse to the elongate axis L. The body 202 includes a number of elements. A leg 204 extends along the transverse axis T, as does a tab 206, which generally extends upward from the leg 204. A first arm 208 extends at an angle a from the body 202. A second arm 210, substantially parallel to the first arm 208, also extends from the body 202. The first arm 208 and second arm 210 define a slot 212 therebetween. The slot 212 is configured to receive an edge of a sheet, as described in more detail below. The body 202 may define a one or more openings 214 for receipt of a fastener, such as a nail, staple, bolt, or other mechanical implement for securing the bracket 200 to a joist. These openings 214 are typically disposed on the leg 204.

Alternatively or additionally, a rear surface 216 of the body 202 may include an adhesive for securing the bracket 200 to a joist. The adhesive may be double-sided tape, where one side of the tape is protected by a barrier, such as a silicone paper, that is removed from the joist-side of the double-sided tape in relatively close temporal proximity to the placement of the bracket 200. In other embodiments, adhesives are glue or the like. Utilization of adhesives may help prevent water from leaking behind the bracket 200 and potentially damaging the joist. The angle a from which the first arm 208 and second arm 210 extend may be as required or desired for a particular application. In certain embodiments, the angle a may be between about 5 degrees and about 85 degrees, between about 15 degrees and about 75 degrees, and between about 25 degrees and about 65 degrees. In certain embodiments, the angle can be about 45 degrees.

To limit degradation when exposed to extremes of temperature and the elements, the bracket 200 is typically formed of extruded materials, such as PVC, HDPE, LDPE, rubber, and other types plastics or otherwise resilient materials. The tab 206 may be extruded of the same material as the leg 204 and arms 208, 210. Alternatively, for reasons described in more detail below, it may be desirable to utilize a highly flexible material for the tab 206. Such a material may be coextruded with the main portion of the body 202 so as to form a unitary part. Such material may include FPVC, TEKNOR, APEX, or other highly flexible material. Additionally, depending on the application, all or part of the bracket 200 may be manufactured of robust metals such as steel, aluminum, or stainless steel. These metals may be coated with plastic or sprayed with coatings or layers to prevent corrosion and increase durability.

Figure 3:
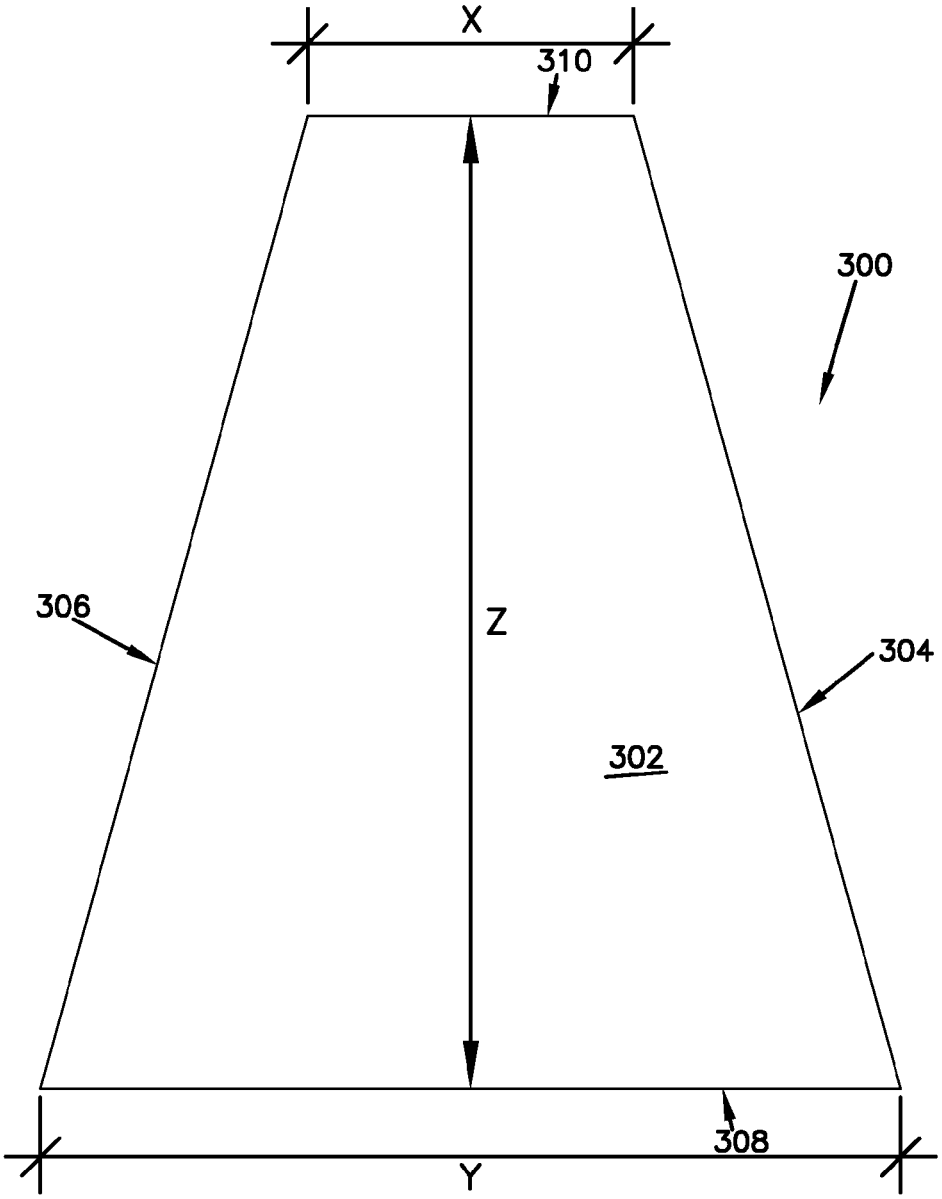
FIG. 3 is a top view of a deck drainage sheet.

FIG. 3 depicts a sheet element 300 that is configured to span a pair of brackets in a deck drainage system. The sheet 300 is a thin, flexible material, typically plastic such as extruded HDPE, polyethelene, or other resilient material. Additionally, the sheet may be manufactured of the same material as the bracket. Materials that resist degradation, mold growth, and/or tearing may be utilized in certain embodiments. Coated metals or plywood may also be utilized. In certain embodiments, the sheet need only be about 1/16 inch nominal thickness, although other thicknesses are contemplated. Additionally, materials having a smooth upper surface 302 to promote proper drainage may be utilized. Rectangular or trapezoidal sheets 300 (as depicted in FIG. 3) may be utilized in the systems described herein. Trapezoidal sheets are manufactured such that the edges 304, 306 taper towards each other from a wide end 308 to a narrow end 310. Trapezoidal sheets 300 have certain advantages, in that the edges 304, 306 may be inserted into opposing brackets that have been installed level on sides of opposing joists, thus forming a sag or trough along a central portion of the sheet 300. Due to the trapezoidal shape, the sag increases along the length of the sheet 300. This is described in more detail below. For decks having joists about 12 inches on-center, a width x of the narrow end 310 may be about 10 inches may be utilized. For decks having joists about 16 inches on-center, the width x of the narrow end 310 may be about 14 inches. The length z may vary depending on the length of the deck joists. The pitch of this increasing sag or trough may be dictated at least in part by the width y of the wide end 308 of the sheet 300. Sheets that have larger differences between width x and width y will display greater pitch once installed.

Figures 4, 5:
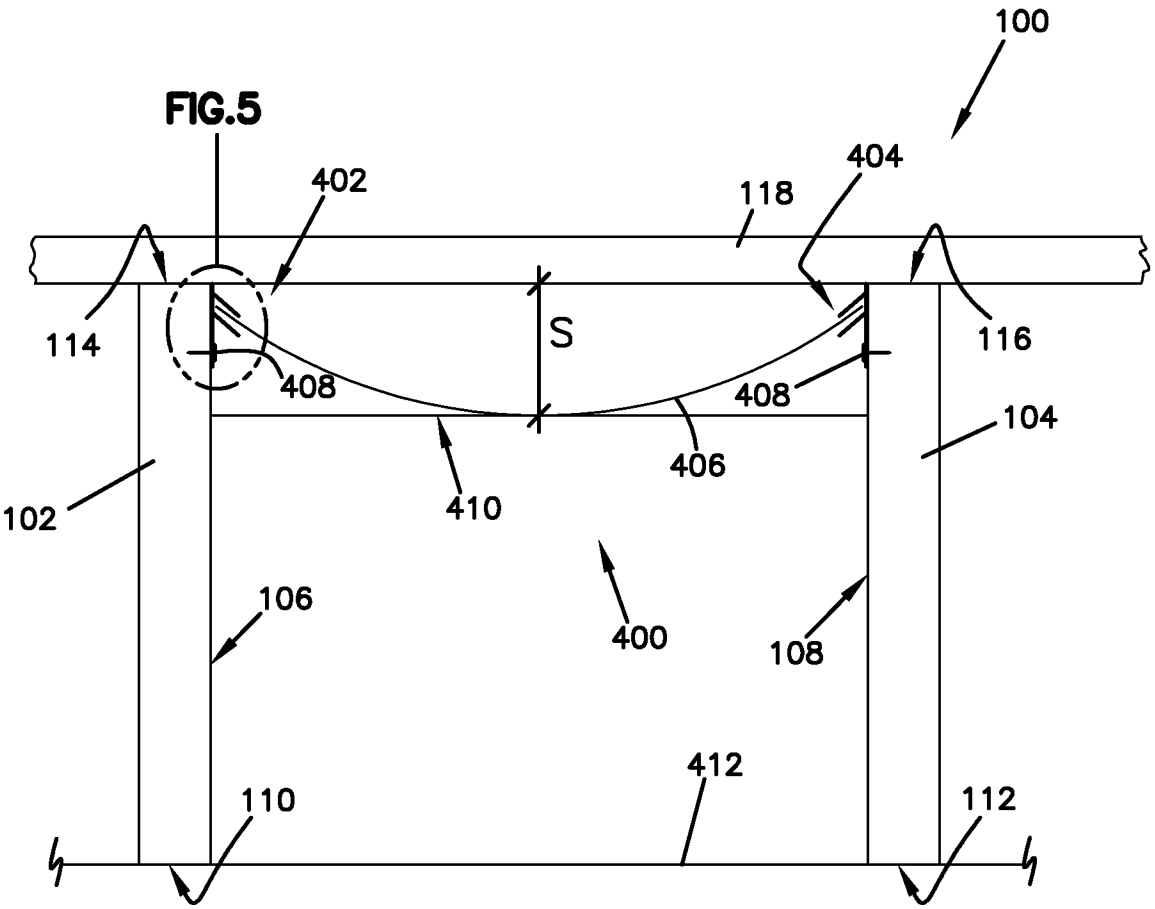
FIG. 4 is a partial end view of a deck utilizing a deck drainage system.
FIG. 5 is an enlarged partial end view of a deck utilizing a deck drainage system.
Figure 5:
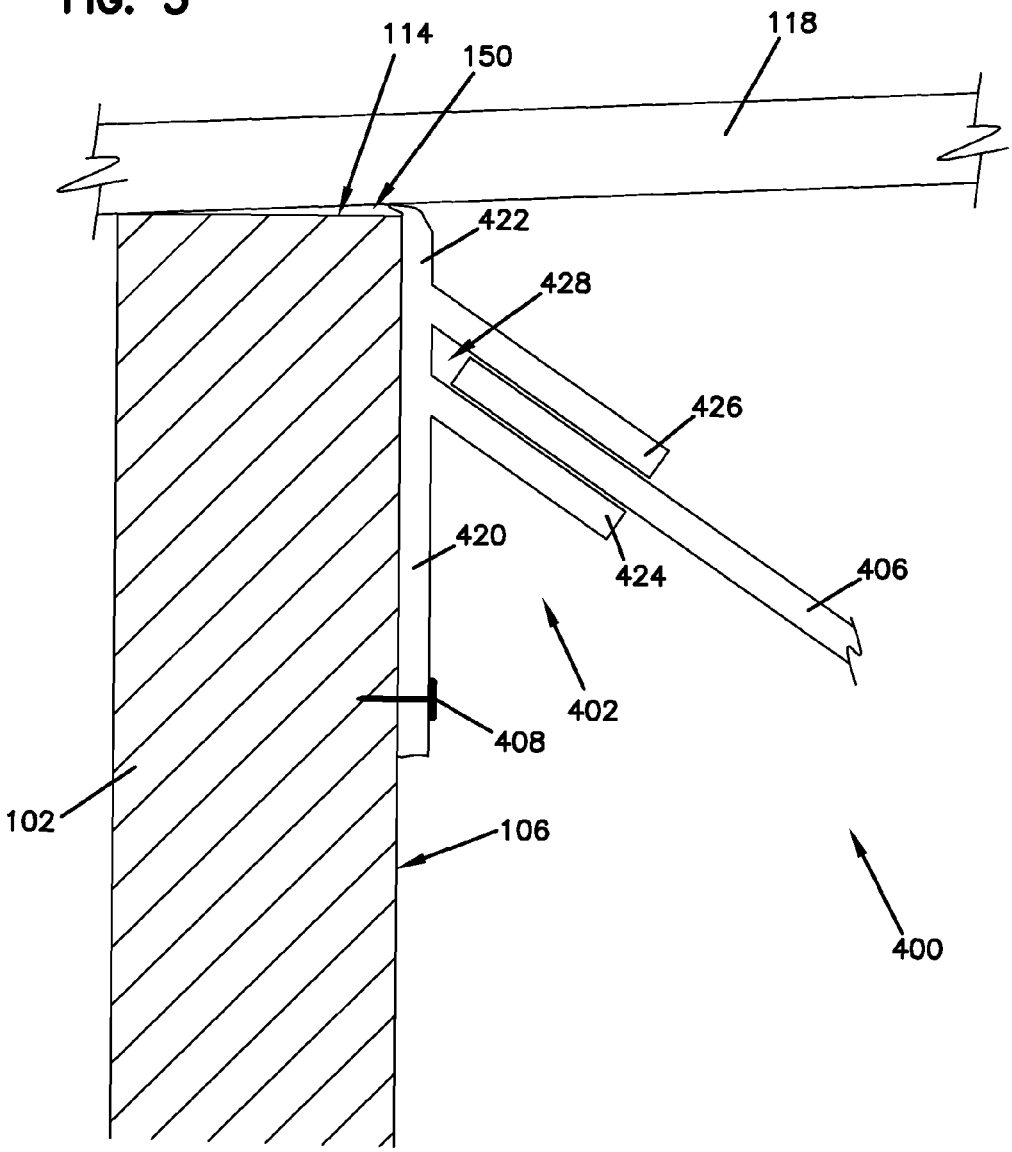

An example of a deck 100 with a deck drainage system 400 is depicted in FIG. 4. As described above with regard to FIG. 1, the support structure of the deck 100 includes joists 102, 104, typically installed on with a center-to-center distance d of about 16 inches or about 12 inches. Of course, other distances d may be utilized. The height h of each joist may be as required or desired for a particular application based on the materials selected. The joists 102, 104 have opposing side surfaces 106, 108, bottom surfaces 110, 112, and top surfaces 114, 116. The drainage system 400 includes at least two brackets 402, 404, such as described herein. The bracket 402 is installed such that the rear surface thereof abuts the side surface 106 of the joist 102. The bracket 404 is similarly installed against the opposing joist 104. The brackets 402, 404 are installed such that the tab at the upper portion thereof is in contact with the undersides of the plank structure 118. Advantages of this installation configuration are described in further detail below.

A sheet 406 spans the brackets 402, 404 and is held between the arms of the brackets 402, 404 due to the friction created between the edges of the sheet 406 and the arms, as the sheet biases towards its initial, flat configuration. Thus, the sheet 406 forces the brackets 402, 404 away from each other and into the joists 102, 104. This force may be sufficient to hold the brackets 402, 404 in place against the opposing side surfaces 106, 108 of the joists 102, 104. Fasteners 408 may also be used to further secure the brackets 402, 404. Thus, the sheet 406 forms an increasing sag or trough a distance s below the deck structure 118. This distance s increases along the length of the joists 102, 104. Adhesives may be used to further secure the sheet 406 to the brackets 402, 404, but are not required.

For longer deck drain systems 400, the weight of the sheet 406 may be such that additional support thereof may be desirable to help prevent the sheet 406 from pulling free from the brackets 402, 404. As such, one or more braces 408 may be installed at predetermined spacing intervals. Braces 410, if used, are generally installed against the bottom of the sheet 406, for example, at three foot intervals. The braces need not be rigid. For example, straps similar to those utilized to hang piping may be used, or the brace may be manufactured of the same material as the sheet member. For aesthetic purposes, a screen, plate, or other material 412 may be installed against the bottom surfaces 110, 112 of the joists 102, 104. This material 412 limits the visibility of the deck drainage system 400 from below. Although any type of material 412 may be used, a screen or perforated material may be desirable in certain embodiments to promote airflow between the joists 102, 104. The material may be colored to match the building architecture or may be printed with a pattern or painted.

FIG. 5 depicts an enlarged partial end view of the system 400 of FIG. 4. As described above, when installed, the bracket 402 abuts the side surface 106 of the joist 102. A fastener 408 is used to secure the bracket 402 to the joist 102. The construction of the bracket 402 enables it to accommodate variations in construction and building materials, so as to redirect water passing through the plank structure 118. As can be seen in FIG. 5, plank structure 118 is installed not completely tight to the top surface 114 of the joist 102. This may be due to surface variations on one or both elements, manufacturing or construction defects, etc. To address this, and to prevent water from leaking behind the bracket 402, the tab 422 is manufactured of a resilient material that allows it to deform as required upon installation. The bracket 402 is installed with the tab 422 in contact with or otherwise abutting the underside of the plank structure 118. This allows the tab 422 to bend, twist, deflect, and otherwise conform as needed to accommodate a given construction. Here, for example, the tab 422 bends into a gap 150 that exists between the deck structure 118 and top surface 114 of the joist 102. This allows the water to be properly guided onto the sheet 406, notwithstanding the construction. As depicted, water would be channeled down the tab 422, onto the second arm 426, and onto the sheet 406 to be redirected. The sheet 406 is disposed in the slot 428 between the first arm 424 and second arm 426. By installing the bracket 402 tight to the underside of the deck structure 118, water leakage down the joists is significantly reduced or eliminated. Of course, the deck drainage system 400 described herein may be installed such that the brackets 402 are disposed anywhere along the height of the joists 102, and may even be pitched if desired. However, by installing the bracket 402 level and tight to the underside of the plank structure 118, a larger portion of the joist 102 is protected from water, unlike water drainage systems that are installed lower on the joist, which exposes more surface area of the joist.

Figure 5A:
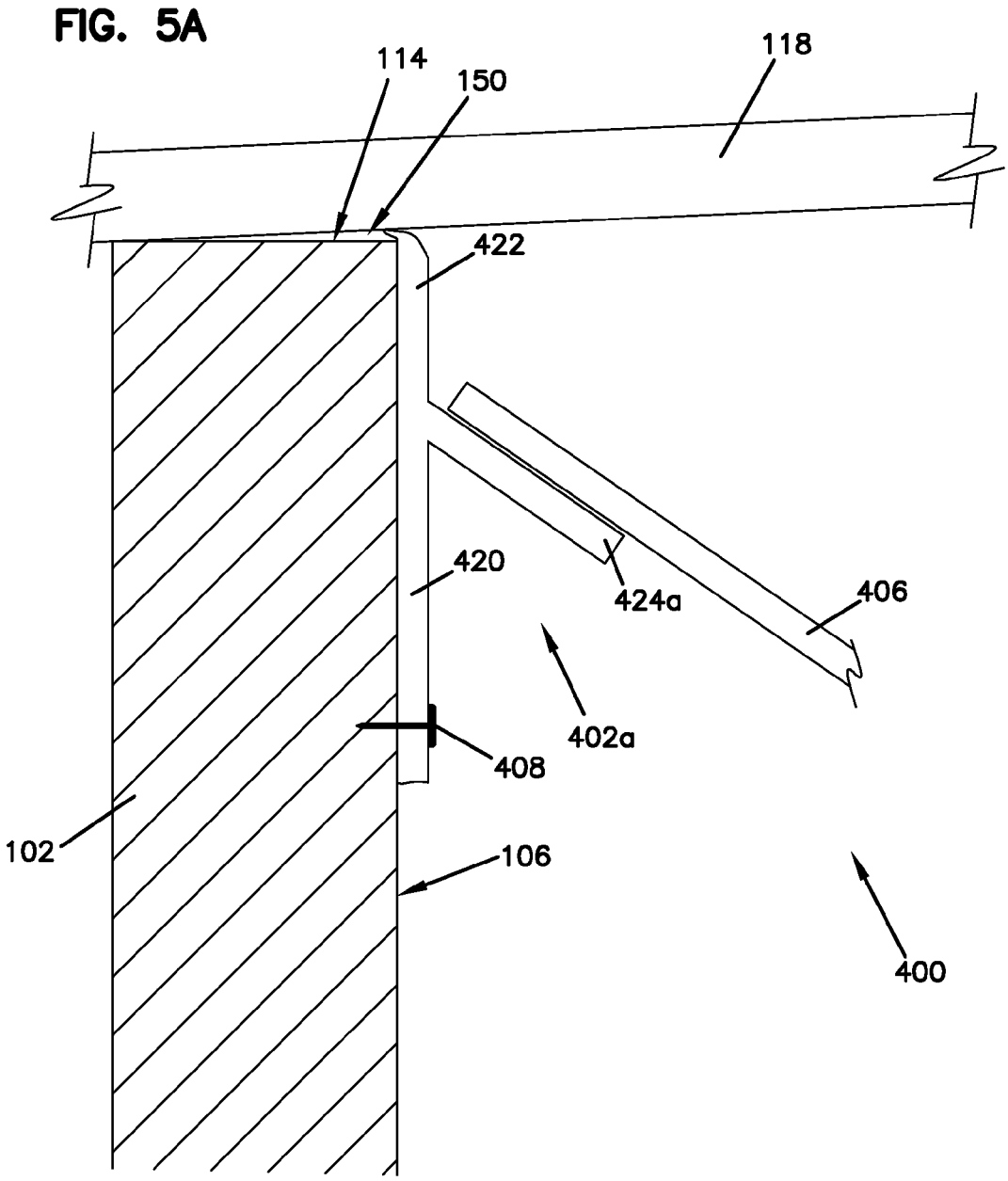
FIG. 5A is an enlarged partial end view of a deck utilizing another embodiment of a deck drainage system.

FIG. 5A depicts another embodiment of a drainage system, including a bracket 402*a*. The other elements depicted in FIG. 5A are similar to those in FIG. 5 and are not described further, unless noted. Here, the bracket 402*a* includes only a single arm 424*a*. The sheet 406 rests on the arm 424*a* and the resilience of the sheet material biases the edges of the sheet 406 outward against the joists. In this embodiment, the single arm 424*a* of the bracket 402*a* provides sufficient support at the edge of the sheet 406 to prevent the sheet from falling once installed.

Figure 5B:
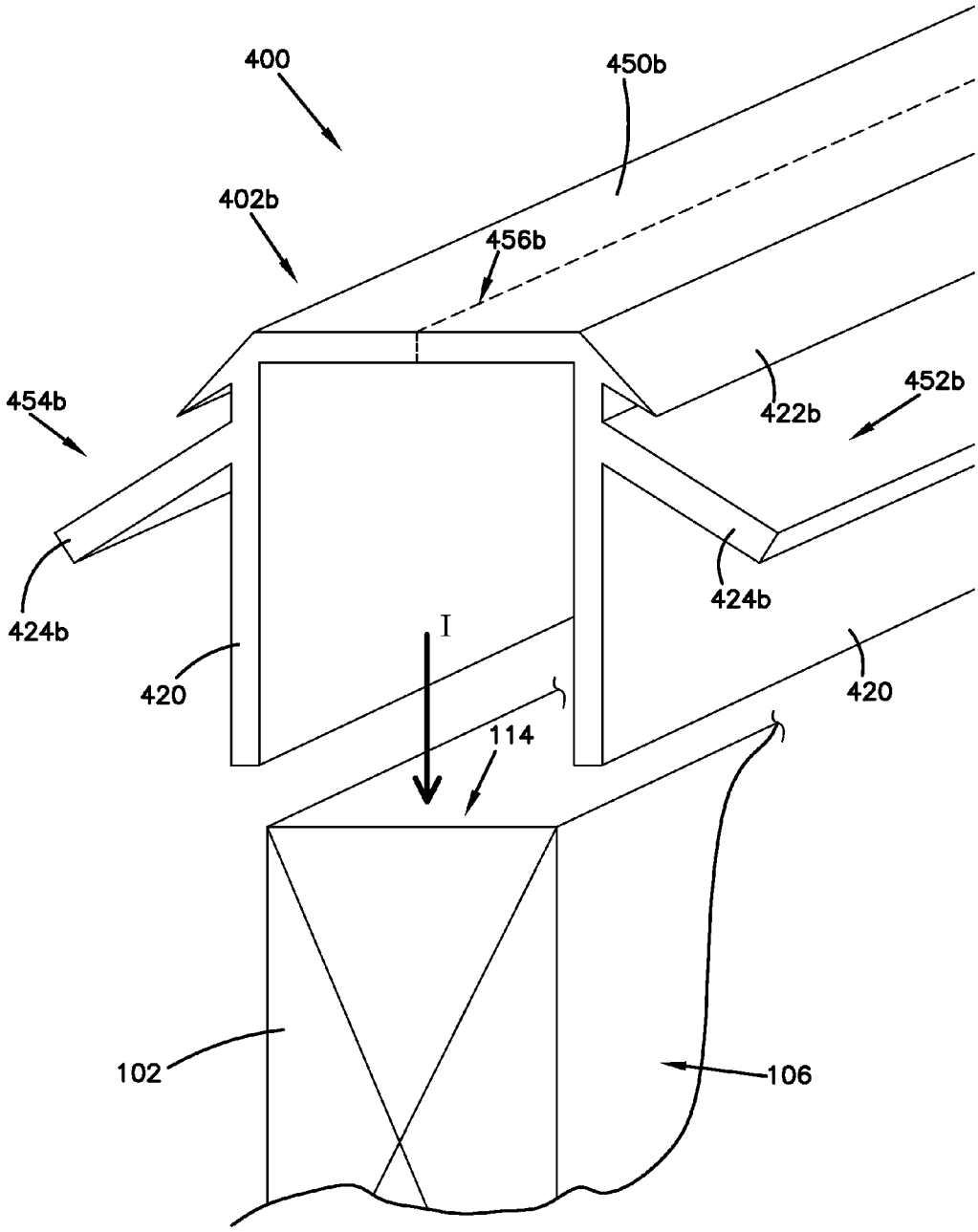
FIG. 5B is an enlarged partial perspective view of a deck utilizing another embodiment of a deck drainage system.

FIG. 5B depicts another embodiment of a drainage system 400, including a bracket 402*b*. The other elements depicted in FIG. 5B are similar to those in FIG. 5 and are not described further, unless noted. Here, the bracket 402*b* includes a first portion 452*b*,a second portion 454*b*,and a top portion 450*b* joining portions 452*b* and 454*b*. In this embodiment, the bracket 402*b* is installed I so as to substantially surround an upper portion of a joist 102. Accordingly, this bracket system 400 may be utilized in new deck construction, prior to installation of a plank structure on top of the joists 102. A single arm 424*b* may be used to support a sheet, as described above with regard to FIG. 5A. Of course, embodiments with two arms, such as the embodiment of FIG. 5 may also be utilized. A tab 422*b* may extend at any angle from a leg 420, so as to direct water into the trough formed by the sheet material. The top portion 450*b* joins the first and second portions 452*b*, 454*b*. The top portion 450*b* shields the joist 102 from water or liquids and defines a seam 456*b* that may be broken to split the first portion 452*b* from the second portion 454*b*. This allows the bracket 402*b* to be installed at a joist located proximate an edge of the deck without being visible. The bracket 402*b* may be secured directly to the joist with fasteners through the top portion 450*b* or the legs 420, as described above. Alternatively, the bracket 402*b* may be fixed in place when the plank structure is secured to the joists 102.

Figure 6:
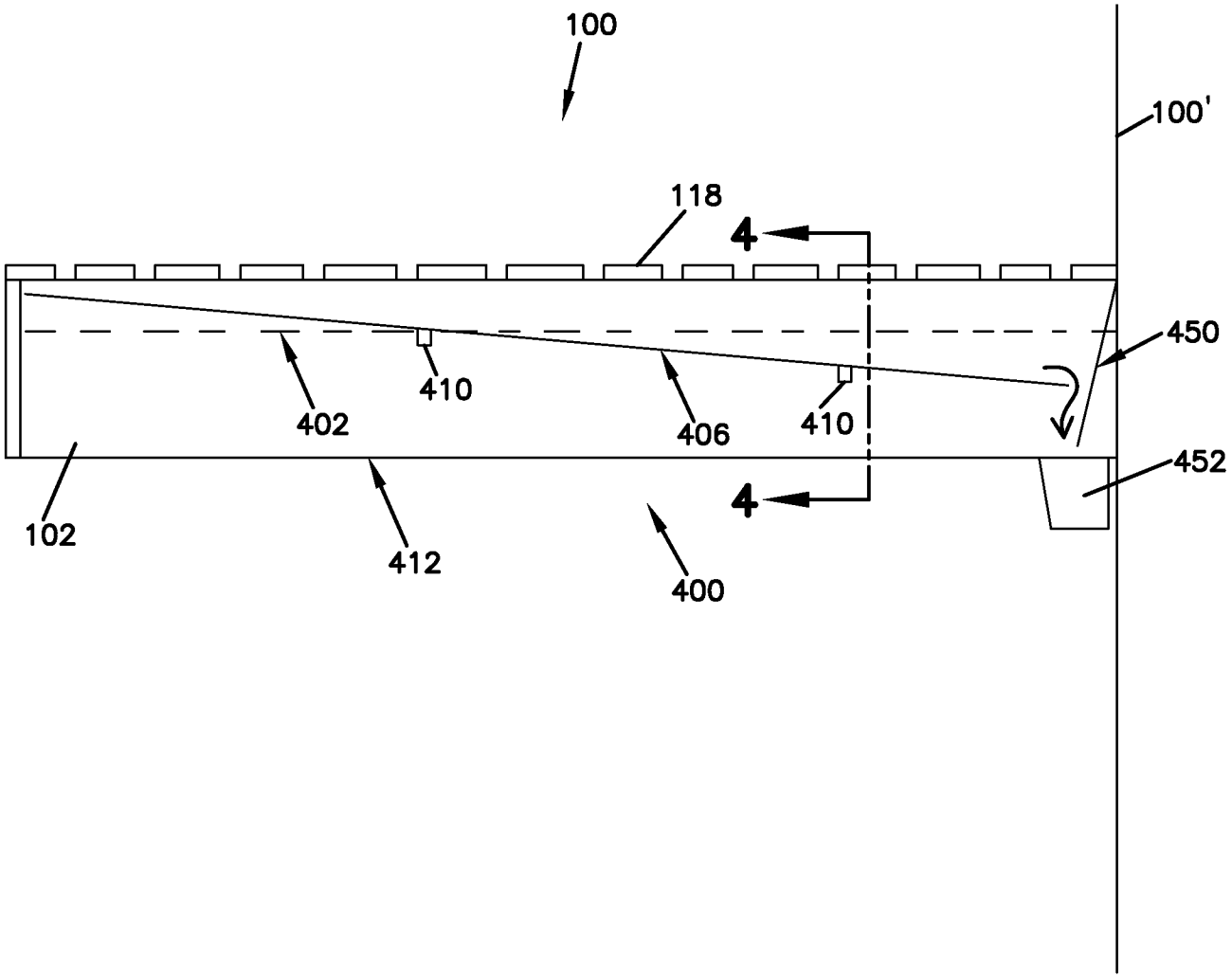
FIG. 6 is a partial side view of a deck utilizing a deck drainage system.

FIG. 6 depicts a partial side view of a deck 100 extending from a building 100' and utilizing a drainage system 400. As depicted above, plank structure 118 spans a top of a plurality of joists, although only one joist 102 is depicted in FIG. 6. The bottom of a bracket 402 is depicted by a dotted line, for clarity. As described above, the bracket 402 is installed abutting the plank structure 118 so as to limit exposure of the joist 102 to the elements. The sheet 406 is depicted by a line, the pitch of which is exaggerated for illustrative purposes. In practice, the pitch of the sheet may be about 1 inch per 10 feet of travel. Other pitches to expedite draining are contemplated. Steeper pitches may be desirable in locales where freezing of slowly moving water is likely. Braces 410 are included to provide additional support to the sheet 406.

In the depicted system 400, the sheet 406 drains water towards the building 100'. A deflector 450, made from the same material as the sheet 406 and bowed outward from the building 100', prevents the water from contacting the building 100', slows the flow of water, and deflects the water into a gutter 452, as depicted by the arrow. The gutter 452 may then be routed to a building downspout, either new or existing, for removal from the building 100'. Of course, the deck drainage system may also be pitched away from the building 100', as required or desired for a particular application.

Figure 7:
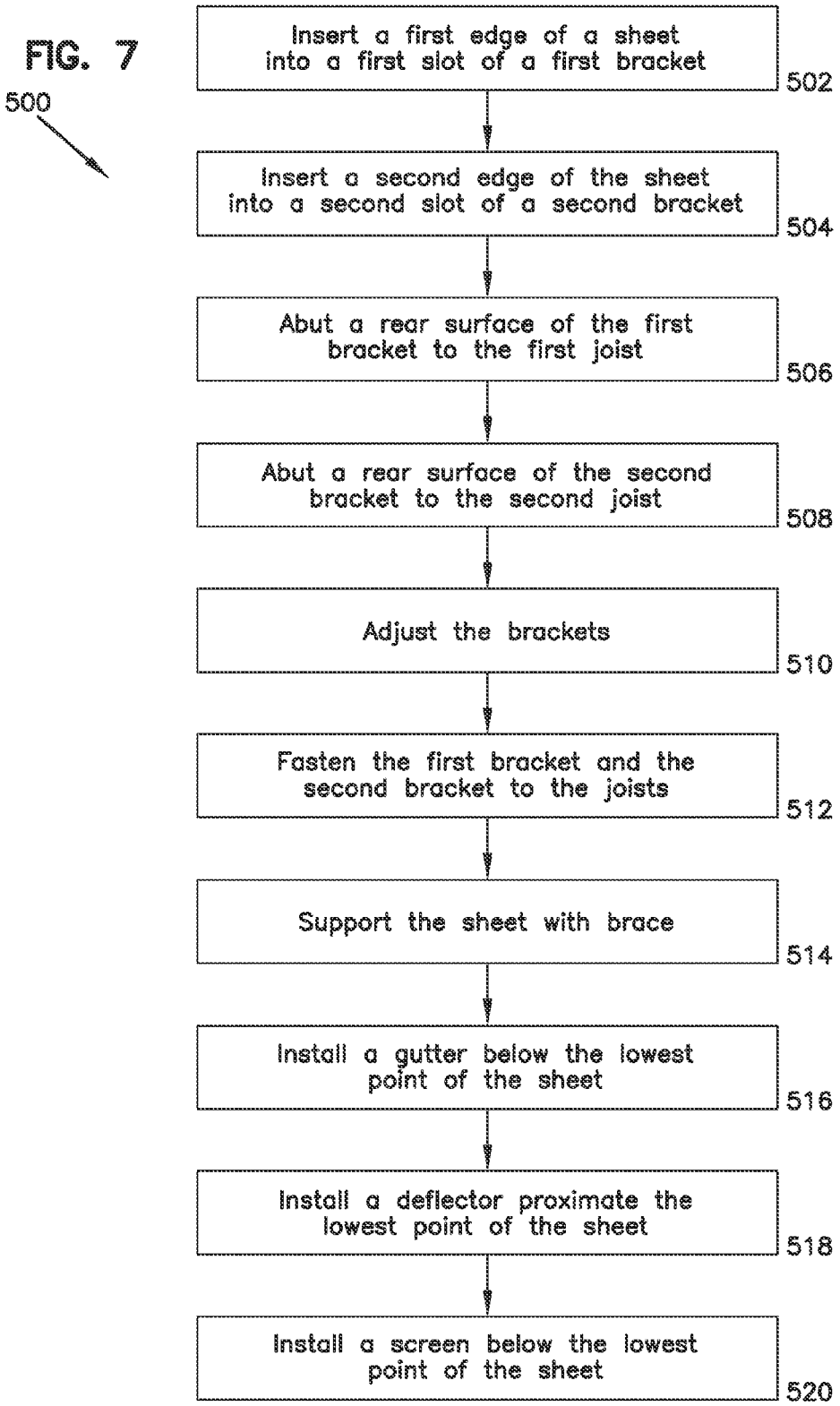
FIG. 7 depicts a method of installing a deck drainage system.

FIG. 7 depicts a method 500 of installing a deck drainage system. The method begins by inserting a first tapered edge of a sheet into a slot of a first bracket (operation 502). A second tapered edge of the sheet is inserted into a slot of a second bracket (operation 504). A rear surface of the first bracket is then abutted against a side surface of a first joist (operation 506). A rear surface of the second bracket is abutted against a side surface of a second joist (operation 508). The simplicity and light weight of the systems disclosed herein allow even these first four operations to be performed by a single installer. Once operation 506 is performed and the first bracket is abutting the first joist, the flexibility of the sheet allows the sheet to be deflected and the second bracket easily placed against the second joist. Even without fasteners, the force created by the bent sheet holds the sheet and brackets in place. The installer may then adjust the brackets (operation 510). Such adjustments may include pitching the brackets, if desired, or may include forcing the brackets tight to the underside of a plank structure of the deck. This may be done by simply forcing the brackets upwards until abutting contact with the underside of the structure is made. Alternatively, abutting the brackets against the underside of the plank structure may occur as each bracket is abutted against its respective joist.

At this time, if required or desired, fasteners may be attached to the brackets to hold them in place (operation 512). If the length of the sheet is particularly long, or if otherwise desired, the sheet may be supported in one or more locations with one or more braces (operation 514). A gutter may be installed below the lowest point of the sheet (operation 516)

and routed to an existing downspout, in certain embodiments. A deflector may also be installed against a building wall, proximate the lowest portion of the sheet (operation 518). This deflector may simply be a piece of plastic, similar to the sheet element, placed between the two joists that are spanned by the sheet. If required or desired for aesthetic or other purposes, a screen can be installed below the lowest point of the sheet (operation 520). The order of the operations described above is not critical, and other methods are contemplated. For example, installation of the gutter may be performed prior to installation of the sheet material. Also, brackets may be secured to the joists prior to insertion of the sheet material into the slot. Securing the brackets to the joists, followed by installation of the sheet material may be particularly useful in the installation of the embodiment of FIG. 5A.

Figure 8A:
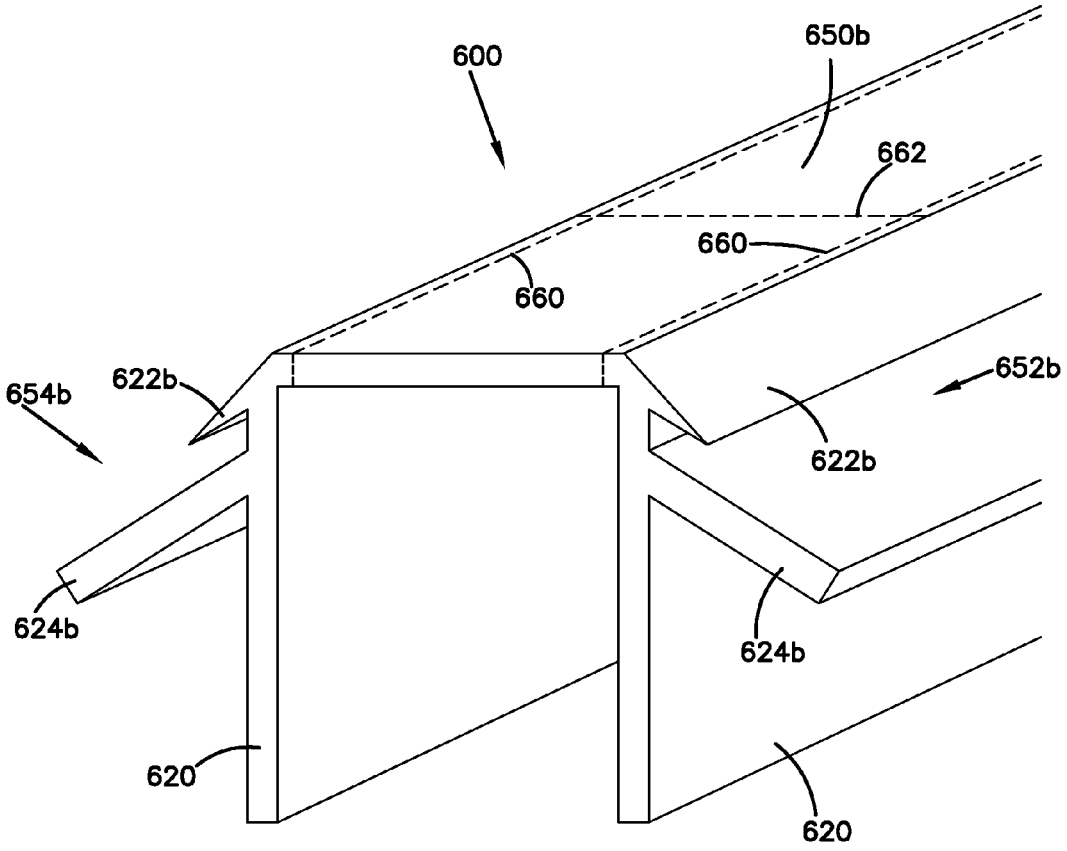
FIG. 8A is an enlarged partial perspective view of a bracket for a deck drainage system.

FIG. 8A is an enlarged partial perspective view of a bracket 600 for a deck drainage system. The other elements depicted in FIG. 8A are similar to those in FIGS. 5 and 5B and are not described further, unless noted. Here, the bracket 600 includes a first portion 652*b*,a second portion 654*b*,and a top central portion 650*b* joining portions 652*b* and 654*b*. In the depicted embodiment, a single arm 624*b* may be used to support a sheet element, as described above with regard to FIG. 5A. Of course, embodiments with two arms, such as the embodiment of FIG. 5 may also be utilized. A tab 622*b* may extend at any angle from a leg 620, so as to direct water into the trough formed by the sheet material. The top portion 650*b* joins the first and second portions 652*b*,654*b*. This bracket 600 may be utilized in new deck construction as the embodiment of FIG. 5B. However, this bracket 600 includes additional features that increase versatility and manufacturability of the bracket 600 and other components of a deck drainage system.

More specifically, the depicted bracket 600 includes seams 660 that join the top central portion to the first portion 652*b* and the second portion 654*b*. The seams 660 allow each of the first portion 652*b* and the second portion 654*b* to be selectively separable from the top central portion 650*b*. The seams 660 may be defined by a perforation or a portion of material that is thinner than the material of the top portion 650*b*. This allows the bracket 600 to be cut or torn more easily. Alternatively, depending on the stiffness of the material utilized, the seams 660 may define weak points that may be broken. In other embodiments, the seams 660 may be defined by a mark present on the top central portion 650*b* that may be used as a guide for cutting the bracket 600. The top central portion 650*b* may also define one or more separation elements 662 disposed generally orthogonal to an axis of the bracket 600. The separation elements 662 may also be present on the first and second portions 652*b* 654*b*. These separation elements 662 may be similar in configuration to the seams 660 described above, and are used to ease cutting, tearing, or separation of the bracket 600 or portions thereof, as described in more detail below.

Figure 8B:
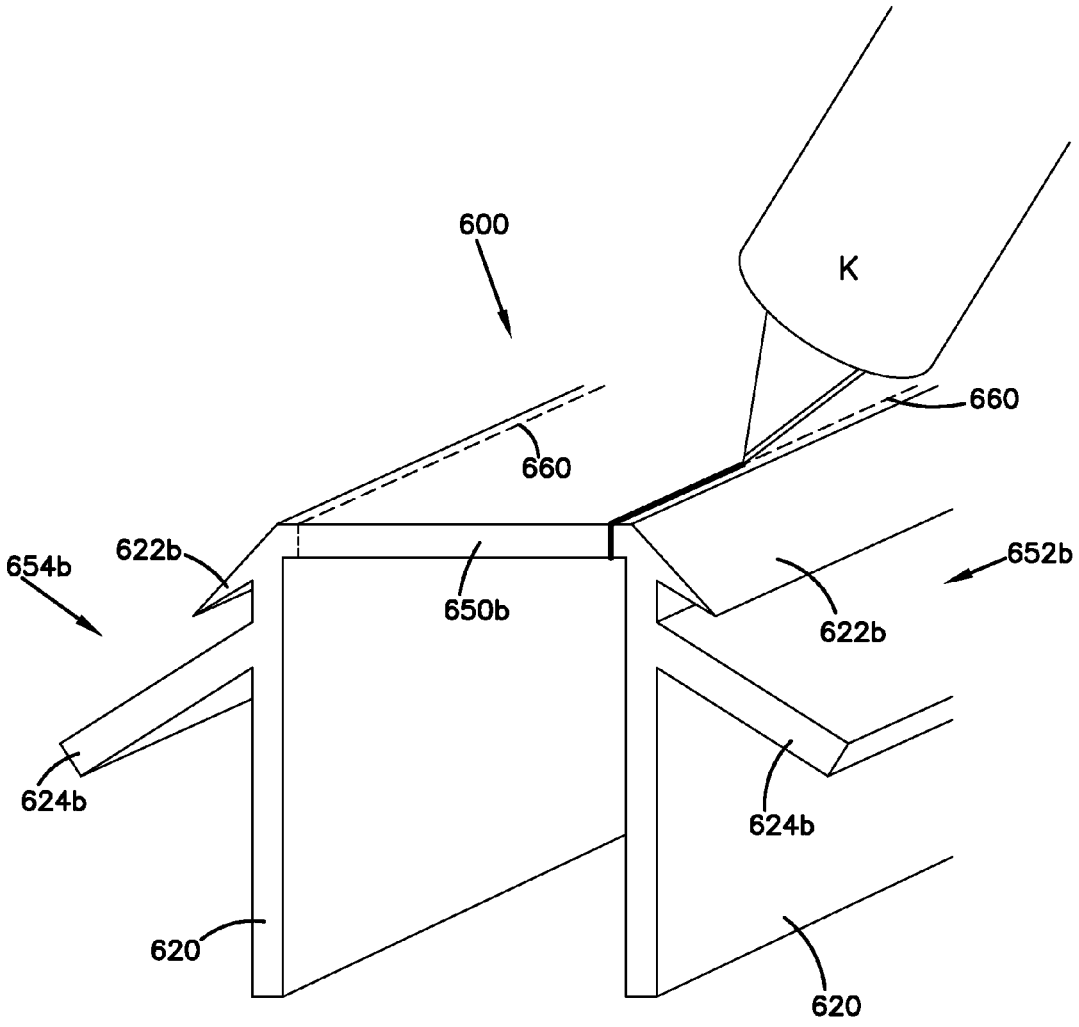
FIG. 8B is an enlarged partial perspective view of the bracket of FIG. 8A being cut for installation.
Figure 8C:
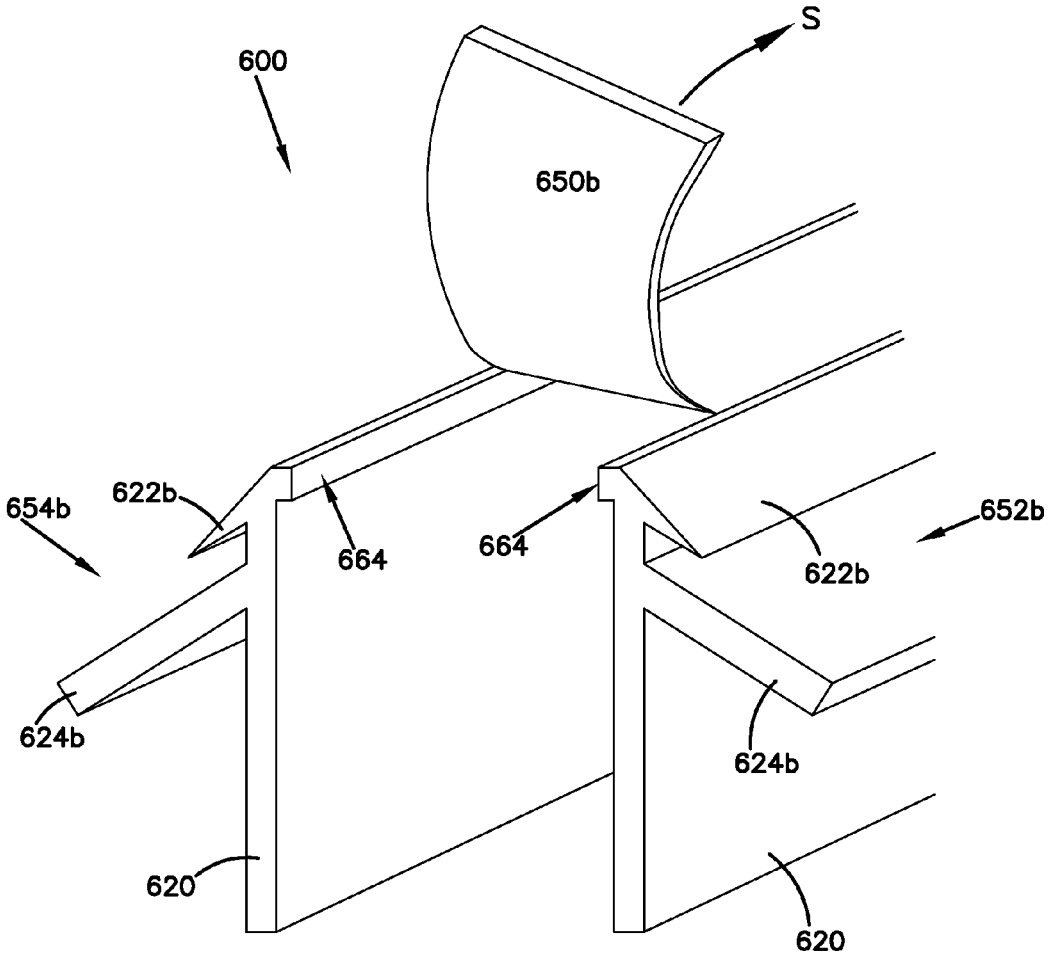
FIG. 8C is an enlarged partial perspective view of the bracket of FIG. 8A being separated for installation.

FIG. 8B is an enlarged partial perspective view of the bracket 600 of FIG. 8A being cut for installation. In this case, a utility knife K or other implement may be used to cut along the seam 660 so as to separate the top central portion 650*b* from the first portion 652*b*. Once the top portion 650*b* is separated from the first portion 652*b*,the top portion 650*b* may be similarly separated from the second portion 654*b*. FIG. 8C is an enlarged partial perspective view of the bracket 600 of FIG. 8A being separated for installation. Once both the first 652*b* and the second 654*b* portions are separated S from the central portion 650*b*,the first portion 652*b* and second portion 654*b* may be installed on a joist as described above. In such a case, the edge of each portion 652*b*, 654*b* proximate the now-separated top portion 650*b* may function as the tab as depicted in FIGS. 2, 5, and 5A. The top central portion 650*b* may be cut into multiple top portions as required or desired and used as the brace to support the sheet element, as depicted in FIGS. 4 and 6. The bracket 600 configuration depicted in FIGS. 8A-8C includes, in a single article, a significant number of the components of a deck drainage system, thereby easing manufacturing of such a system. The bracket 600 may be continuously extruded utilizing a single die, cut (or rolled, depending on the flexibility of the material), and packaged with sheet material, fasteners, and/or screen material. Once ready to be installed, the various components of the bracket may be separated as described herein and installed. Thus, the bracket 600 reduces waste during both manufacture and installation.

The deck drainage systems described herein may be sold as a kit, either in a single package or in multiple packages. A kit may include a sheet, one or more brackets, braces, deflectors, screens, or each of these components may be sold separately. If desired, fasteners and gutters may be included, although instructions included with the kit may also specify the types of these components recommended, based on the particular installation. In certain embodiments, the bracket may be sold as a single extruded piece that may be field-cut into two or more pieces. Similarly, the sheet material may be field-cut to a desired length. The screen material may also be modifiable. Adhesive glues for securing the brackets to joists may also be included in the kit or acceptable types may be identified in the instructions.

This disclosure described some embodiments of the present technology with reference to the accompanying drawings, in which only some of the possible embodiments were shown. Other aspects can, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. A deck drainage system comprising:

a bracket comprising:

a first portion comprising a first leg having a rear surface and a first arm and a substantially parallel second arm disposed at an angle to the first leg and extending downwardly from a surface of the first leg opposite the rear surface of the first leg when in use;

a second portion comprising a second leg having a rear surface and a first arm and a substantially parallel second arm disposed at an angle to the second leg and extending downwardly from a surface of the second leg opposite the rear surface of the second leg when in use, and wherein the second leg is separate from the first leg; and a central portion connecting the first portion and the second portion, wherein the rear surface of the first leg faces the rear surface of the second leg, and wherein the central portion is selectively separable from both the first portion at a first seam and the second portion at a second seam, so as to separate the first portion from the second portion.

2. The deck drainage system of claim 1, wherein the seam comprises a perforation.

3. The deck drainage system of claim 1, wherein the seam comprises a thickness less than a thickness of the central portion.

4. The deck drainage system of claim 1, wherein the seam comprises a mark.

5. The deck drainage system of claim 1, wherein the central portion defines at least one separation element disposed substantially orthogonal to the seam.

6. A kit for useful in forming a deck drain, the kit comprising:

a sheet element comprising a first edge and a second edge;

a bracket, comprising a first bracket portion, a second bracket portion, and a top portion, wherein the top portion is connected to the first bracket portion at a first seam, and the top portion is connected to the second bracket portion at a second seam, and wherein the bracket is selectively separable along the first seam and the second seam into:

the first bracket portion comprising a first slot adapted to receive the first edge;

the second bracket portion comprising a second slot adapted to receive the second edge; and the top portion.

7. The kit of claim 6, wherein the first edge and the second edge define a taper.

8. The kit of claim 6, wherein the top portion of the bracket is adapted to support a portion of the sheet element once installed between a first joist and a second joist.

9. The kit of claim 8, wherein the first bracket portion comprises a flat rear surface adapted to abut a side surface of the first joist.

10. The kit of claim 9, wherein the first bracket portion comprises a tab adapted to conform to an upper structure disposed on an upper surface of the joist when the rear surface is abutting the side surface of the joist, wherein the tab is formed once the first bracket portion is separated from the top portion.

11. The kit of claim 10, further comprising a screen adapted to be secured to a bottom surface of the first joist.

* * * * *